US006629742B2

(12) United States Patent
Fujii

(10) Patent No.: US 6,629,742 B2
(45) Date of Patent: Oct. 7, 2003

(54) PRINTHEAD, PRINTING APPARATUS USING PRINTHEAD, PRINTHEAD CARTRIDGE, AND PRINTING ELEMENT SUBSTRATE

(75) Inventor: Yasuo Fujii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/067,795

(22) Filed: Feb. 8, 2002

(65) Prior Publication Data

US 2002/0118241 A1 Aug. 29, 2002

(30) Foreign Application Priority Data

Feb. 8, 2001 (JP) ..... 2001-032292

(51) Int. Cl.[7] ..... B41J 29/38

(52) U.S. Cl. ..... 347/12; 347/40; 347/211; 347/180; 347/168

(58) Field of Search ..... 347/9, 12, 237, 347/211, 168, 180, 40, 128, 145, 181, 182, 247

(56) References Cited

U.S. PATENT DOCUMENTS 5,142,302 A * 8/1992 Kano ..... 347/172
5,907,331 A * 5/1999 Markham ..... 347/12
5,975,670 A * 11/1999 Kikuta et al. ..... 347/15
6,471,320 B2 * 10/2002 Anderson ..... 347/12
2001/0045967 A1 * 11/2001 Hayasaki ..... 347/9
2002/0036781 A1 * 3/2002 Hirayama ..... 358/1.4
2002/0039117 A1 * 4/2002 Oikawa ..... 347/14

* cited by examiner

*Primary Examiner*—Judy Nguyen
*Assistant Examiner*—Lam Nguyen
(74) *Attorney, Agent, or Firm*—Fitzpatrick, Cella, Harper & Scinto

(57) ABSTRACT

This invention is to provide a printhead capable of printing at a higher speed even when the number of printing elements is large, a printing apparatus using this printhead, a printhead cartridge, and a printing element substrate. For this purpose, print signals necessary for driving M printing elements belonging to each of N divisional blocks and a select control signal necessary for block selection are transferred by inputting print signals corresponding to L (L<M) printing elements serially from a first signal line by using a clock signal and inputting print signals corresponding to the remaining (M−L) printing elements and a corresponding select control signal serially from a second signal line by using the same clock signals.

16 Claims, 6 Drawing Sheets

DATA2
D 5-BIT SHIFT REGISTER
Q1 Q2 Q3 Q4 Q5
108
D1 D2 D3 D4
LT 4-BIT LATCH CIRCUIT
Q1 Q2 Q3 Q4
109
110
B4 B3 B2 B1
4 → 12 DECODER
N1 N2 N3 N4 N5 N6 N7 N8 N9 N10 N11 N12
12
VH
D1
N1 A1 T1 H1
N2 A2 T2 H2
N11 A11 T11 H11
N12 A12 T12 H12
D2
N1 A13 T13 H13
N2 A14 T14 H14
N11 A23 T23 H23
N12 A24 T24 H24
D27
N1 A313 T313 H313
N2 A314 T314 H314
N11 A323 T323 H323
N12 A324 T324 H324
27
GNDH
107
D16 D15 D2 D1 D27 D26 D18 D17
104
ENB
LATCH
Q1 Q2 Q15 Q16
LT 16-BIT LATCH CIRCUIT
D1 D2 D15 D16
Q1 Q2 Q10 Q11
LT 11-BIT LATCH CIRCUIT
D1 D2 D10 D11
106
103
DATA1
CK
D Q1 Q2 Q15 Q16
16-BIT SHIFT REGISTER
D Q1 Q2 Q10 Q11
11-BIT SHIFT REGISTER
105

PRINTHEAD, PRINTING APPARATUS USING PRINTHEAD, PRINTHEAD CARTRIDGE, AND PRINTING ELEMENT SUBSTRATE

FIELD OF THE INVENTION

The present invention relates to a printhead, a printing apparatus using the printhead, a printhead cartridge, and a printing element substrate and, more particularly, to a printhead employing an ink-jet scheme of discharging ink by utilizing, e.g., heat energy, a printing apparatus using the printhead, a printhead cartridge, and a printing element substrate.

BACKGROUND OF THE INVENTION

In a printhead employing an ink-jet scheme of printing by utilizing heat energy, heat-generating elements are formed at a portion which communicates with discharge orifices for discharging ink droplets. Power is supplied to the heat-generating elements for only about several microseconds to generate bubbles in the ink. The ink droplets are discharged from the discharge orifices by utilizing the bubbling power, thereby printing. In this printhead, a large number of discharge orifices and heat-generating elements can be arranged at a high density. Thus, high-quality image printing can be performed.

When all the heat-generating elements of the printhead are driven simultaneously, the total current instantaneously supplied to the printhead becomes undesirably large. Usually, several ten to several hundred heat-generating elements are divided into a plurality of blocks. The driving timings of the respective blocks are slightly differed from each other, so all the heat-generating elements of the printhead are controlled not to be driven simultaneously. In this manner, the total current which flows instantaneously is suppressed low.

To drive a large number of heat-generating elements, a driving circuit for the elements is incorporated in the printhead, such that the number of wires between the printhead and a printing apparatus on which the printhead is mounted does not increase. In a widely used structure, this driving circuit is incorporated in a Si (silicon) wafer used as a substrate for the heat-generating elements.

The arrangement of the driving circuit varies, and its typical arrangement will be described below.

The driving operation of each heat-generating element is controlled by a block control signal (BLKn) representing the block number of the corresponding heat-generating element and a print signal (DATA) corresponding to the block control signal As the block control signal (BLKn), one obtained by encoding the block number into binary data is used. A value obtained by dividing the number (T) of all the heat-generating elements by a total number (N) of blocks is the number of heat-generating elements (M=T/N) that can be driven simultaneously by one driving operation. If 1 bit of print data corresponds to one heat-generating element and the print data is transferred in a number of bits corresponding to the number of heat-generating elements which are to be driven simultaneously by one driving operation, M corresponds to the number of bits of the print signal (DATA) that drives the print elements simultaneously by one driving operation.

The driving circuit has gates and transistors corresponding in number of bits to the number (T) of heat-generating elements. The driving circuit also has shift registers and latch circuits corresponding in number to the number of bits of the print signal (DATA) which drives the print elements simultaneously by one driving operation and to the number of bits of the block control signal (BLKn). One serial data formed of such a print signal (DATA) and block control signal (BLKn) is serially transferred from the printing apparatus to the shift registers and latched. The latched block control signal is decoded. Consequently, transistors corresponding to the respective heat-generating elements are driven through gates corresponding to the driving signals supplied to the respective blocks.

The transistors can be either bipolar transistors or FETs.

The above conventional driving circuit has the following problems.

If the printhead has many heat-generating elements, the bit length of the serial data formed of the print signal and block control signal increases. Serial data transfer is performed by using one signal line.

Assume that an increase in cost of the manufacture of the printhead is to be prevented by introducing a semiconductor manufacturing apparatus and producing circuit substrates for the printheads on a mass production basis, and that the cost is to be reduced by commonizing devices. In order to practice such cost increase prevention and cost down, if the same semiconductor process is used for manufacturing the printheads, manufacture cannot be performed by forming a circuit in which the transfer clock frequency of serial data is specially increased.

Therefore, as the bit length of the serial data increases, the time required for transferring the serial data increases naturally. As a result, the transfer time becomes an obstacle in shortening the print time.

SUMMARY OF THE INVENTION

The present invention has been made in view of the above prior art, and has as its object to provide a printhead which can print at a higher speed even if the number of print elements is large, a printing apparatus using the printhead, a printhead cartridge, and a printing element substrate.

In order to achieve the above object, a printhead according to the present invention has the following arrangement.

More specifically, the printhead comprises M×N printing elements divided into N blocks each consisting of M printing elements, and time-divisionally driven with M printing elements for each of N times, M×N driving circuits for driving the M×N driving elements by supplying power thereto, a first shift register for inputting print signals corresponding to, of print signals corresponding to the M printing elements, L (L<M) printing elements serially from a first signal line by using a clock signal, and for temporarily storing the input print signals, a second shift register for inputting print signals corresponding to, of the print signals corresponding to the M printing elements, (M−L) printing elements and a select control signal for selecting one of the N blocks serially from a second signal line by using the clock signal, and for temporarily storing the input print signals and the select control signal, and a selective driving circuit for driving the M printing elements belonging to a block selected on the basis of the select control signal, by the print signals which are stored in the first and second shift registers and correspond to the M printing elements.

The printhead may comprise a first latch circuit for latching the print signals stored in the first shift register and corresponding to the L printing elements, a second latch circuit for latching the print signals stored in the second shift registers and corresponding to the (M−L) printing elements, and a third latch circuit for latching the select control signal stored in the second shift register.

The printhead may comprise a decoding circuit for decoding the select control signal latched by the third latch circuit, thus forming a block select signal for performing block selection.

The selective driving circuit may include an AND circuit for calculating logical products of the print signals latched by the first and second latch circuits and the block select signal, and may select printing elements to drive on the basis of a calculation result of the AND circuit.

In place of providing a decoding circuit, the block select control signal latched by the third latch circuit may be a block select signal which does not need decoding.

The first, second, and third latch circuits preferably perform latch operation in response to a common latch signal.

The M×N printing elements preferably include electrothermal transducers, and the printhead preferably includes an ink-jet printhead for printing by discharging ink. This ink-jet printhead further preferably generates heat energy to be supplied to the ink by supplying power to the electrothermal transducers, so the ink is discharged by utilizing the heat energy.

According to another aspect of the present invention, there is provided a printhead cartridge comprises a printhead and an ink tank for holding ink to be supplied to the printhead being connected to each other, the printhead comprising M×N printing elements, M×N driving circuits for dividing the M×N driving elements into N blocks each consisting of M printing elements and time-divisionally driving M printing elements N times each, a first shift register for inputting print signals corresponding to, of print signals corresponding to the M printing elements, L (L<M) printing elements serially from a first signal line by using a clock signal, and for temporarily storing the input print signals, a second shift register for inputting print signals corresponding to, of the print signals corresponding to the M printing elements, (M−L) printing elements and a select control signal for selecting one of the N blocks serially from a second signal line by using the clock signal, and for temporarily storing the input print signals and the select control signal, and a selective driving circuit for driving the M printing elements belonging to a block selected on the basis of the select control signal, by the print signals which are stored in the first and second shift registers and correspond to the M printing elements.

The printhead and the ink tank can be separated from each other, or can be integral with each other.

According to still another aspect of the present invention, there is provided a printing apparatus for printing comprises a printhead and control means for controlling so as to convert print data into print signals corresponding to M printing elements per block printing, and to transfer the print signals to the printhead through the first and second signal lines by using a clock signal, the printhead comprising M×N printing elements, M×N driving circuits for dividing the M×N driving elements into N blocks each consisting of M printing elements and time-divisionally driving M printing elements N times each, a first shift register for inputting print signals corresponding to, of print signals corresponding to the M printing elements, L (L<M) printing elements serially from the first signal line by using the clock signal, and for temporarily storing the input print signals, a second shift register for inputting print signals corresponding to, of the print signals corresponding to the M printing elements, (M−L) printing elements and a select control signal for selecting one of the N blocks serially from the second signal line by using the clock signal, and for temporarily storing the input print signals and the select control signal, and a selective driving circuit for driving the M printing elements belonging to a block selected on the basis of the select control signal, by the print signals which are stored in the first and second shift registers and correspond to the M printing elements.

The control means preferably controls to transfer an enable signal, in order that while transferring the print signals corresponding to one block printing to the printhead, printing elements corresponding to one block for which transfer has been performed immediately before this transfer are driven, thereby printing.

According to still another aspect of the present invention, there is provided a printing element substrate comprises at least M printing elements×N blocks and M×N driving circuits corresponding to the M printing elements×N blocks, a first shift register for inputting print signals corresponding to, of print signals corresponding to the M printing elements, L (L<M) printing elements serially from a first signal line by using a clock signal, and for temporarily storing the input print signals, a second shift register for inputting print signals corresponding to, of the print signals corresponding to the M printing elements, (M−L) printing elements and a select control signal for selecting one of the N blocks serially from a second signal line by using the clock signal, and for temporarily storing the input print signals and the select control signal, and a selective driving circuit for driving the M printing elements belonging to a block selected on the basis of the select control signal, by the print signals which are stored in the first and second shift registers and correspond to the M printing elements, wherein the at least M printing elements×N blocks, the M×N driving circuits, the first shift register,the second shift register and the selective driving circuit are formed on one substrate.

With the above arrangement, according to the present invention, print signals necessary for driving the M printing elements belonging to each of the N divisional blocks and the select control signal necessary for block selection are transferred by inputting the print signals corresponding to the L (L<M) printing elements serially from the first signal line by using the clock signal and inputting the print signals corresponding to the remaining (M−L) printing elements and the corresponding select control signal serially from the second signal line by using the same clock signals.

According to still another aspect of the present invention, there is provided a printhead comprises a plurality of printing elements, dividing/driving circuits for dividing the plurality of printing elements into a plurality of blocks and driving the plurality of blocks, a first shift register for inputting print signals corresponding to, of print signals corresponding to a plurality of printing elements constituting one block, a predetermined number of printing elements serially from a first signal line by using a clock signal, and for temporarily storing the input print signals, a second shift register for inputting print signals corresponding to printing elements different from the predetermined number of printing elements constituting the one block and a block select signal for selecting a block to be driven serially from a second signal line by using the clock signal, and for temporarily storing the input print signals and the block select signal, and a driving circuit for driving printing elements on the basis of the print signals stored in the first and second shift registers and the block select signal stored in the second shift register.

According to still another aspect of the present invention, there is provided a printing element substrate comprises a plurality of printing elements, dividing/driving circuits for dividing the plurality of printing elements into a plurality of blocks and driving the plurality of blocks, a first shift register for inputting print signals corresponding to, of print signals corresponding to a plurality of printing elements constituting one block, a predetermined number of printing elements serially from a first signal line by using a clock signal, and for temporarily storing the input print signals, a second shift register for inputting print signals corresponding to printing elements different from the predetermined number of printing elements constituting the one block and a block select signal for selecting a block to be driven serially from a second signal line by using the clock signal, and for temporarily storing the input print signals and the block select signal, and a driving circuit for driving printing elements on the basis of the print signals stored in the first and second shift registers and the block select signal stored in the second shift register, wherein the plurality of printing elements, the dividing/driving circuits, the first shift register, the second shift register and the driving circuit are formed on one substrate.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Brief Description of a Printing Apparatus

Figure 1:
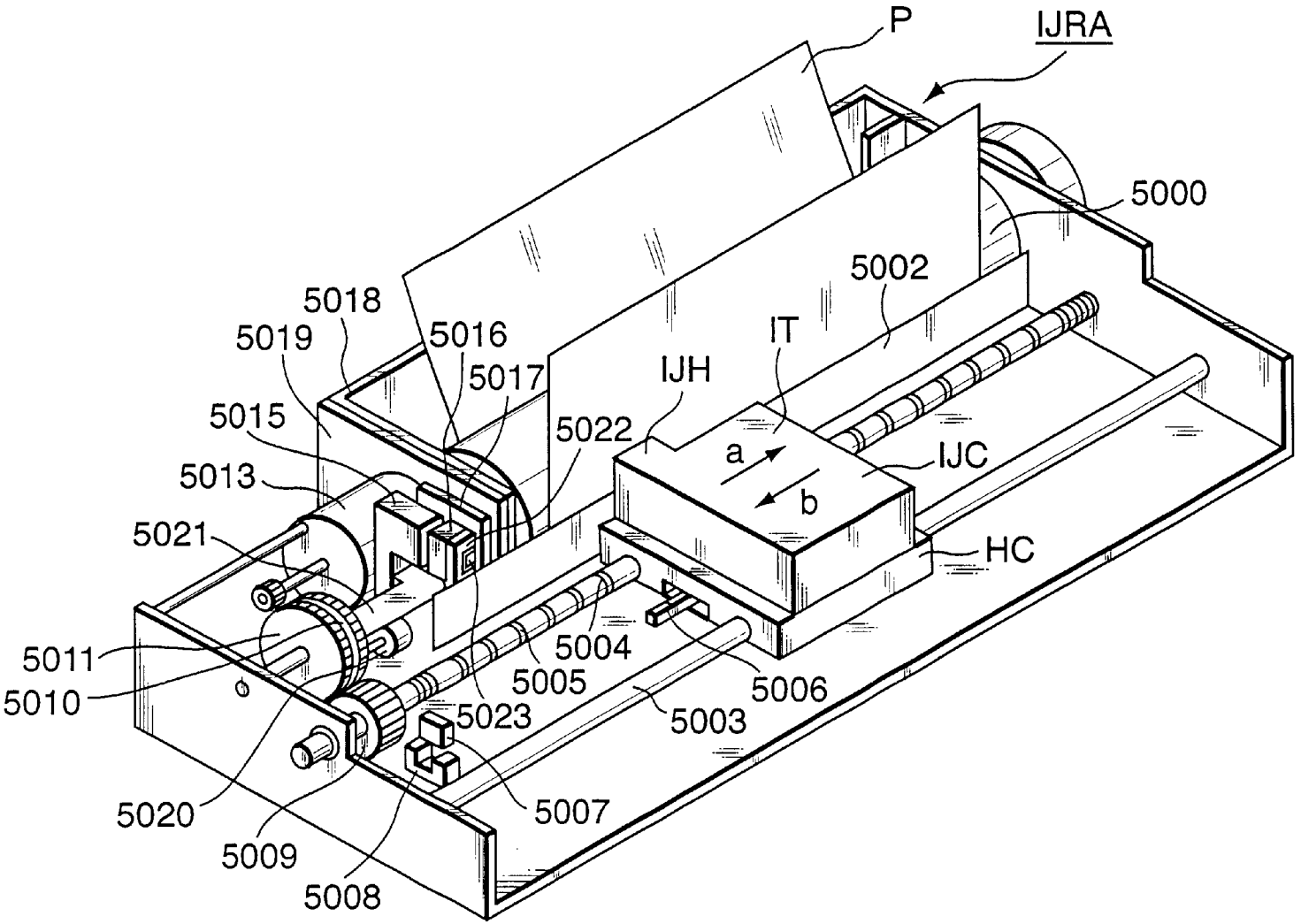
FIG. 1 is a perspective view showing an outer appearance of an ink-jet printer IJRA as a typical embodiment of the present invention.

FIG. 1 is a perspective view showing the outer appearance of an ink-jet printer IJRA as a typical embodiment of the present invention. Referring to FIG. 1, a carriage HC engages with a spiral groove 5004 of a lead screw 5005, which rotates via driving force transmission gears 5009 to 5011 upon forward/reverse rotation of a drive motor 5013. The carriage HC has a pin (not shown), and is reciprocally moved in directions of arrows a and b in FIG. 1. An integrated ink-jet cartridge IJC which incorporates a printhead IJH and an ink tank IT is mounted on the carriage HC. Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of motor 5013. Reference numeral 5016 denotes a member for supporting a cap member 5022, which caps the front surface of the printhead IJH; and 5015, a suction device for sucking ink residue through the interior of the cap member. The suction device 5015 performs suction recovery of the printhead via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Description of a Control Arrangement

Next, the control structure for performing the printing control of the above apparatus is described.

Figure 2:
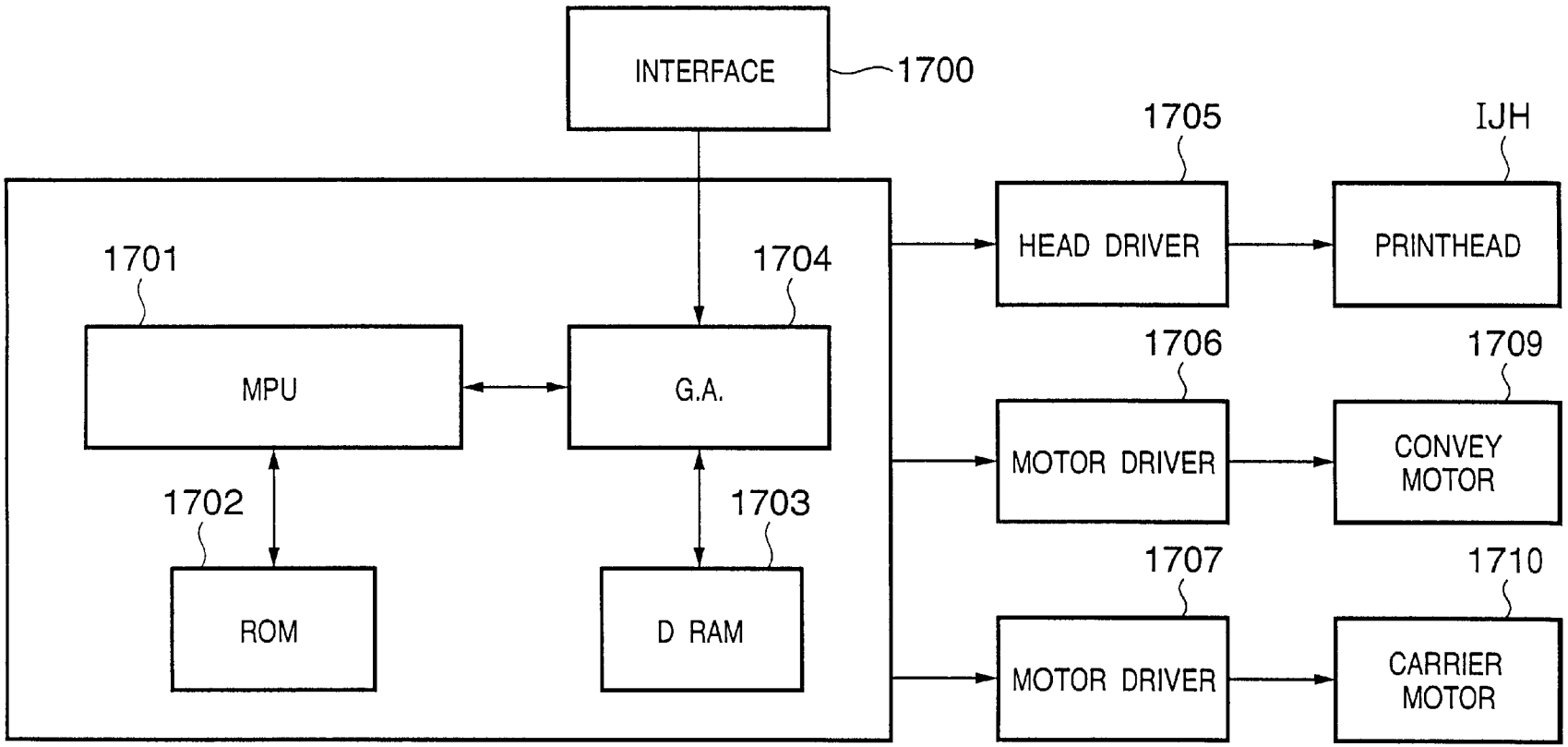
FIG. 2 is a block diagram showing an arrangement of a control circuit of the ink-jet printer.

FIG. 2 is a block diagram showing the arrangement of a control circuit of the ink-jet printer. Referring to FIG. 2 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printhead and the like). Reference numeral 1704 denotes a gate array (G.A.) for performing supply control of print data to the printhead IJH. The gate array 1704 also performs data transfer control among the interface 1700, the MPU 1701, and the RAM 1703. Reference numeral 1710 denotes a carrier motor for transferring the printhead IJH in the main scanning direction; and 1709, a transfer motor for transferring a printing medium(e.g. a paper sheet). Reference numeral 1705 denotes a head driver for driving the printhead; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printhead is driven in accordance with the print data supplied to the head driver 1705, thus performing the printing operation.

Note that the ink tank IT and the printhead IJH are integrally formed to construct an exchangeable ink cartridge IJC, however, the ink tank IT and the printhead IJH may be separately formed such that when ink is exhausted, only the ink tank IT can be exchanged for new ink tank.

Figure 3:
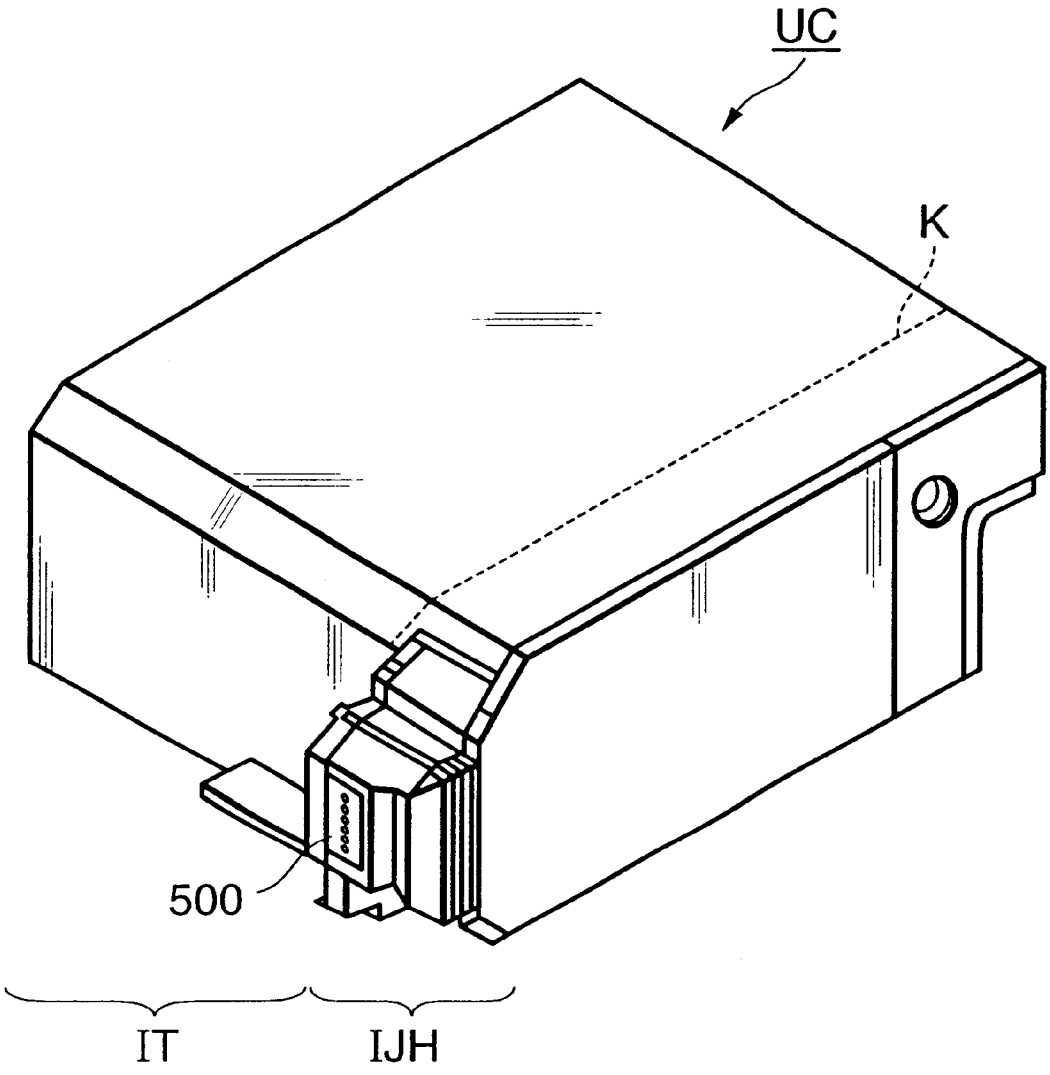
FIG. 3 is a perspective view showing an outer appearance of an ink cartridge IJC in which an ink tank and head can be separated from each other.

FIG. 3 is a perspective view showing the structure of the ink cartridge IJC where the ink tank and the head can be separated. As shown in FIG. 3 in the ink cartridge ITC, the ink tank IT and the printhead IJH can be separated along a line K. The ink cartridge IJC has an electrode (not shown) for receiving an electric signal supplied from the carriage HC side when it is mounted on the carriage HC. By the electric signal, the printhead IJH is driven as above, and discharges ink.

Note that in FIG. 3, numeral 500 denotes an ink-discharge orifice array. Further, the ink tank IT has a fiber or porous ink absorbing body. The ink is held by the ink absorbing body.

The detailed arrangement of the driving circuit of the printhead IJH used in the printer IJRA with the above arrangement will be described.

The printhead IJH for discharging ink according to this embodiment has 324 printing elements(heat generating elements). These printing elements are divided into 12 blocks (division number (N)=12) each with 27 printing elements. One printing element of each block (a total of 27 printing elements) is driven simultaneously (number (M) of printing elements driven simultaneously by one driving operation=27).

Detailed Arrangement of Printhead IJH

Figure 4:
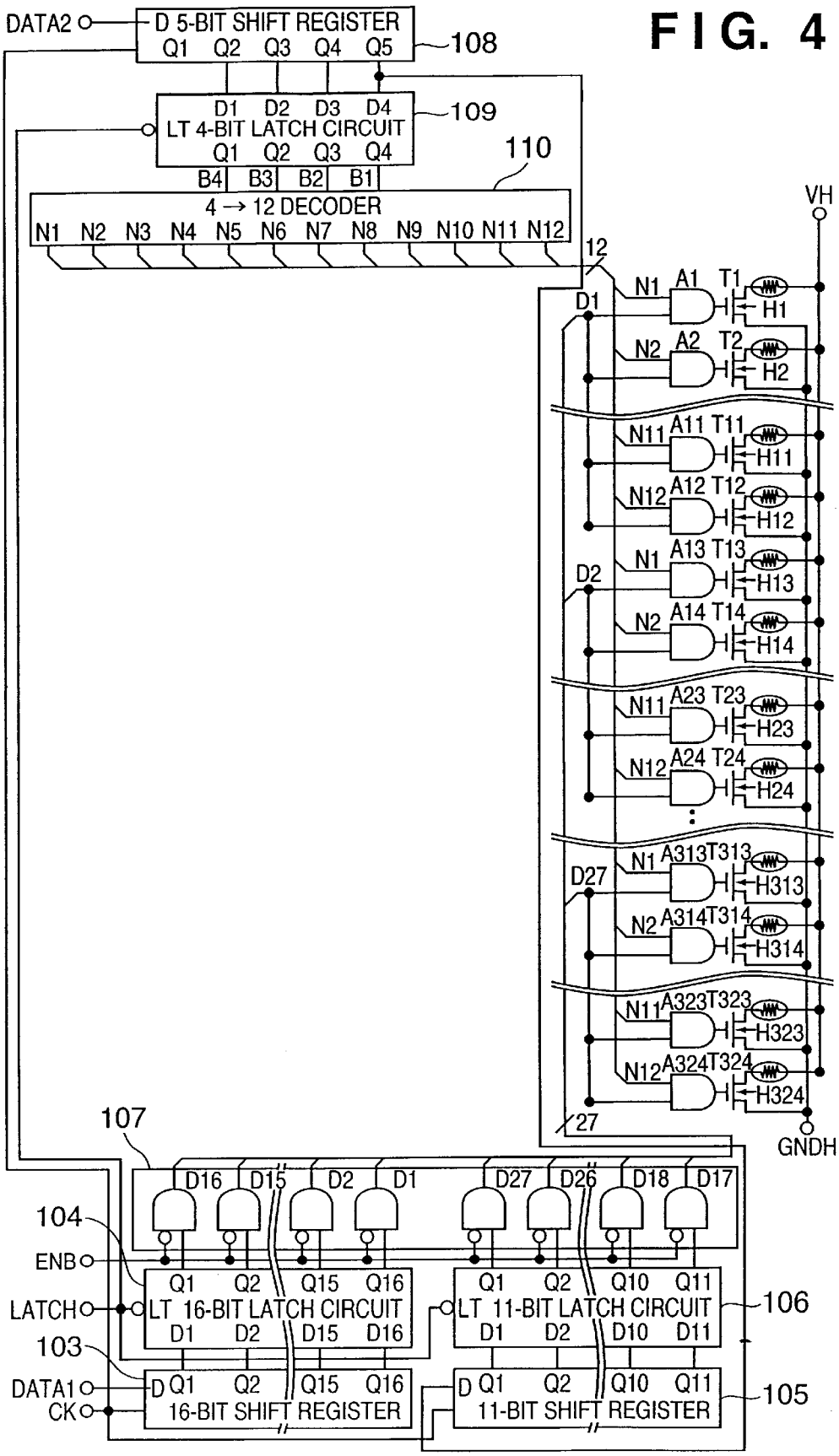
FIG. 4 is a block diagram showing an arrangement of a driving circuit for a printhead IJH.

FIG. 4 is a block diagram showing the arrangement of the driving circuit on an element substrate constituting the printhead IJH. This element substrate is obtained by forming the circuit shown in FIG. 4 on a substrate such as a silicon substrate in accordance with film forming techniques. Liquid channels for supplying ink and discharge orifices for discharging ink are arranged at positions corresponding to heat generating elements on the substrate to form the printhead IJH.

This circuit supplies print signals (D1 to D27) and a block control signal (B1 to B4) to the printhead IJH through shift registers and latch circuits. As shown in FIG. 4, a print signal (DATA1) supplied from the printer IJRA is formed of the print signals (D1 to D16), and a print signal (DATA2) is formed of the print signals (D17 to D27) and the block control signal (B1 to B4).

Referring to FIG. 4, reference numeral 103 denotes a 16-bit shift register to which the print signal (DATA1) is input serially in response to a clock signal (CK) supplied from the printer IJRA. Reference numeral 104 denotes a 16-bit latch circuit for latching the 16-bit print signal (DATA1) stored in the 16-bit shift register 103 in response to a latch signal (LATCH) supplied from the printer IJRA. Reference numeral 108 denotes a 5-bit shift register to which the print signal (DATA2) is input serially in response to the clock signal (CK) supplied from the printer IJRA. Reference numeral 105 denotes an 11-bit shift register to which the print signal (DATA2) shift-output from the 5-bit shift register 108 is input serially in response to the clock signal (CK) supplied from the printer IJRA. Reference numeral 106 denotes an 11-bit latch circuit for latching the 11-bit print data stored in the 11-bit shift register 105 in response to the latch signal (LATCH) supplied from the printer IJRA.

Reference numeral 109 denotes a 4-bit latch circuit for latching the 4-bit block control signal (B1 to B4) stored in the 5-bit shift register 108 in response to the latch signal (LATCH) supplied from the printer IJRA. Reference numeral 107 denotes an AND circuit for calculating the logical products of an enable signal (ENB) and the respective bits of the total of 27-bit print signal latched by the 16-bit latch circuit 104 and 11-bit latch circuit 106.

Reference numeral 110 denotes a 4→12 decoder for receiving and decoding the block control signal (B1 to B4) supplied from the printer IJRA, thereby forming a block select signal (N1 to N12). Reference numerals H1 to H324 denote heat generating elements for printing; T1 to T324, power transistors for supplying power to the heat generating elements H1 to H324; and A1 to A324, AND circuits corresponding to the power transistors T1 to T324. The AND circuits A1 to A324 calculate the logical products of the print signals (D1 to D27) input from the printer IJRA and the block select signal (N1 to N12) output from the 4→12 decoder 110.

In this manner, outputs from the AND circuit 107 are supplied to the heat generating elements H1 to H324 as the print signals (D1 to D27) on the basis of selection performed by the block select signal (N1 to N12). These outputs and the block select signal (N1 to N12) as the output from the 4→12 decoder 110 determine the driving timings and driving pulse widths of the heat generating elements H1 to H324. The enable signal (ENB) operates in negative logic. In other words, the heat generating elements H1 to H324 are driven when the enable signal (ENB) is low.

According to the arrangement shown in FIG. 4, when the supply line of a power supply voltage (VH) and the signal line of a ground voltage (GNDH) are included, 7 signal lines (i.e., one signal line for each of the print signal (DATA1), print signal (DATA2), clock signal (CK), enable signal (ENB), latch signal (LATCH), power supply voltage (VH), and ground voltage (GNDH)) are present between the driving circuit and the printer IJRA.

The driving circuit shown in this embodiment is formed, together with the heat generating elements H1 to H324 and the power transistors T1 to 324 for supplying power to them, on one semiconductor substrate (e.g., a silicon substrate) by using a semiconductor manufacturing process.

Figure 5:
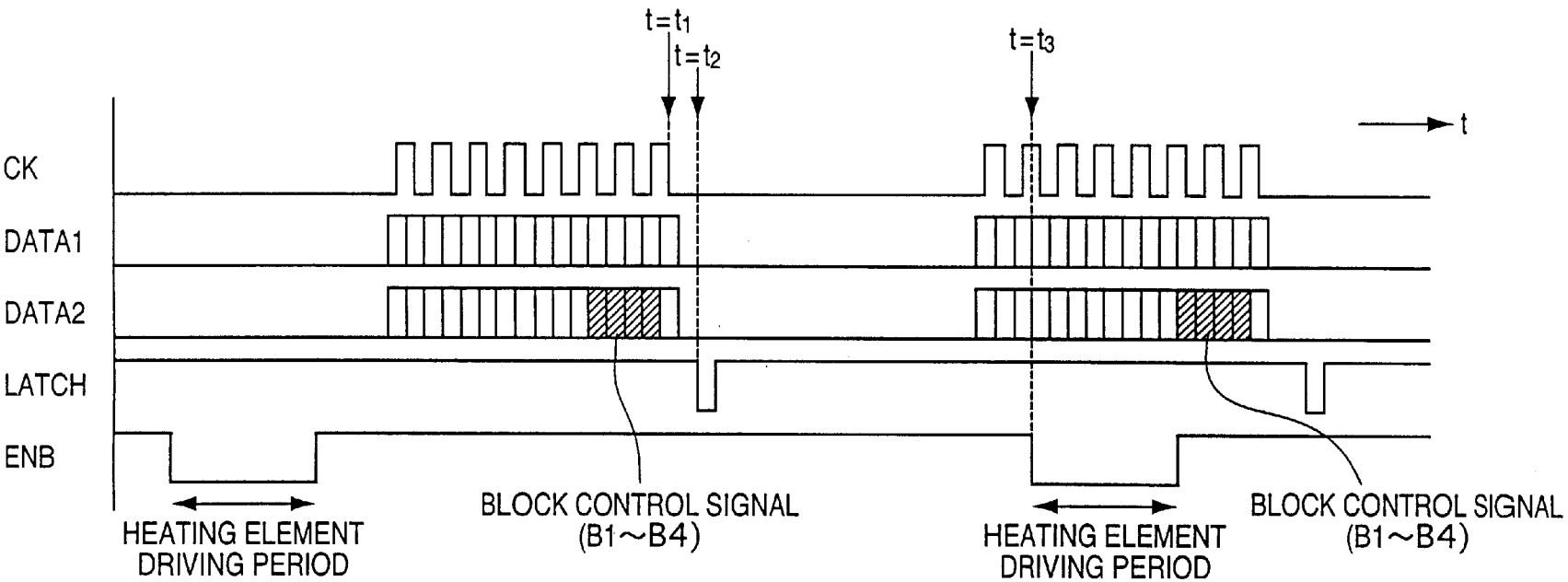
FIG. 5 is a timing chart showing the driving timings for the printhead IJH with the arrangement shown in FIG. 4.

FIG. 5 is a timing chart showing the driving timings of the printhead IJH with the arrangement shown in FIG. 4.

As shown in FIG. 5, and as is apparent from the arrangement shown in FIG. 4, data transfer can be performed in a parallel manner by using the clock signal (CK) which is common to the print signals (DATA1 and DATA2). The 4-bit block control signal (B1 to B4) is transferred, following the 11-bit print signal (DATA2), by using the same signal line. When transfer of the 16-bit print data (DATA1) is ended ($t=t_1$ in FIG. 5), transfer of the 11-bit print signal (DATA2) and 4-bit block control signal (B1 to B4) has also been ended. The latch signal (LATCH) is transmitted immediately ($t=t_2$ in FIG. 5), so the latch operation of the print signals (DATA1 and DATA2) with a total of 27 bits and the 4-bit block control signal (B1 to B4) can be performed.

When the latch operation is complete, the print signals (DATA1 and DATA2) are supplied to the signal input terminals of the AND circuit 107 from the latch circuits, and the block select signal (N1 to N12) is supplied to the signal input terminals of the AND circuits A1 to A324 from the 4→12 decoder 110.

Therefore, as soon as the enable signal (ENB) is supplied from the printer, it drives the power transistors T1 to T324 to print ($t=t_3$). Since the latch operation has been completed in this state, next-cycle print signals (DATA1 and DATA2) and block control signal (B1 to B4) can be input.

As described above, the driving circuit of the printhead IJH according to this embodiment operates even if the timing at which the print signals (DATA1 and DATA2) supplied from the printer are transferred serially by the 16-bit shift register 103, 5-bit shift register 108, and 11-bit shift register 105, and the timing at which the enable signal (ENB) supplied from the printer to drive the heat-generating elements is input overlap each other. As the transfer timing and driving timing can overlap each other timewise, the transfer timing interval of the print signals and the driving timing interval of the heat-generating elements can be shortened. As a result, the print speed of the printer IJRA increases.

Figure 6:
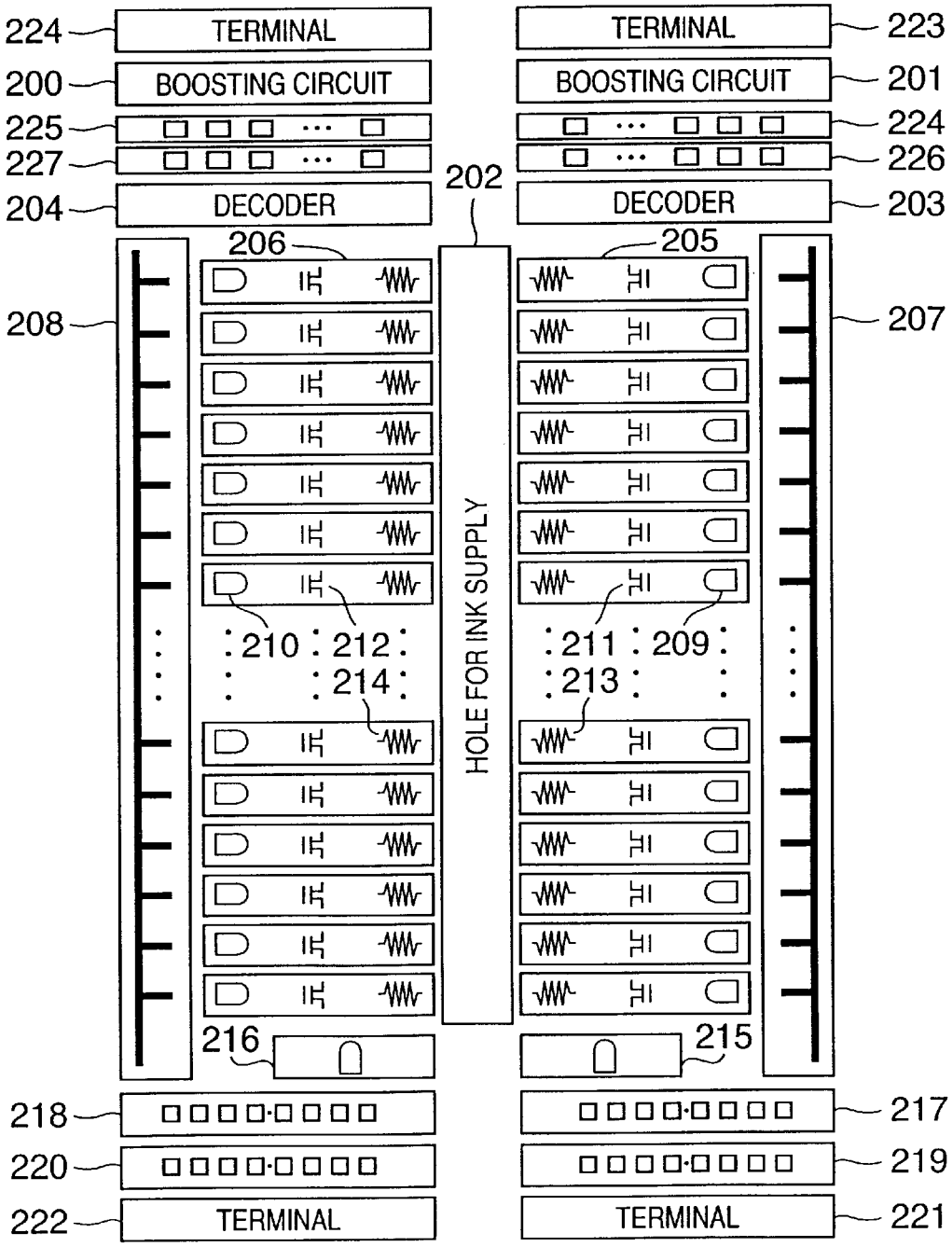
FIG. 6 is a view showing the layout when printhead element substrate is formed on a semiconductor chip.

FIG. 6 is a view showing the layout when printhead element substrate is formed on a semiconductor chip. The layout shown in FIG. 6 has a pair of circuits (FIG. 4) linearly symmetrical about a hole 202 of ink supply. As the material (element substrate) of the printhead element substrate, an Si (silicon) wafer or the like is used as in the conventional case.

Reference numerals 221, 222, 223, and 224 denote input terminals for connecting lines of signals (print data DATA1 and DATA2, latch signal LATCH, clock signal CK, enable signal ENB, power supply voltage VH, and ground voltage GNDH) supplied from the printer IJRA main body to the printhead IJK.

The print data DATA1 is connected to the terminals 221 and 222, and the print data DATA2 is connected to the terminals 223 and 224. Reference numerals 219 and 220 denote 16-bit shift registers each constituted by the 16-bit shift register 103. Reference numerals 224 and 225 denote 16-bit shift registers each constituted by the 5-bit shift register 108 and the 11-bit shift register 105.

Reference numerals 217 and 218 denote 16-bit latch circuits each constituted by the 16-bit latch circuit 104. Reference numerals 226 and 227 denote 16-bit latch circuits each constituted by the 4-bit latch circuit 109 and the 11-bit latch circuit 106.

Reference numeral 215 and 216 denote AND circuits. The AND circuits 215 or 216 are made up of the AND circuits 107. Reference numerals 209 and 210 denote AND circuits. The AND circuits 209 or 210 are made up of the A1 to A324 AND circuits. Reference numerals 211 and 212 denote power transistors. The power transistors 211 or 212 are made up of the T1 to T324 power transistors. Reference numerals 213 and 214 denote heat generating elements. The heat generating elements 213 or 214 are made up of the H1 to H324 heat generating elements. Reference numerals 207 and 208 denote wiring lines. The wiring lines 207 or 208 are made up of signal lines for the signals D1 to D27, N1 to N12, and B1 to B4.

Reference numerals 200 and 201 denote boosting circuits for increasing the gate voltage of the power transistors to be higher than the driving voltage of the logic circuits in order to increase the driving power of the power transistors 211 and 212. The hole 202 of ink supply supplies ink from the lower surface to the heat generating elements H1 to H324. Reference numerals 205 and 206 denote driving circuits each including one heat generating element, and a power transistor and AND gate which are arranged in correspondence with one heat generating element.

Apparently, two signal lines for transferring the print signals (DATA1 and DATA2) simultaneously and a signal line for supplying the common clock signal (CK) necessary for this transfer are connected between the printer which uses the printhead IJH according to this embodiment, and the printhead IJH. The MPU 1701 performs control operation so the following operation is obtained. Namely, 324-bit print data per print operation is divided into 12 to match the arrangement of the printhead IJH. Each of the twelve divisional 27-bit print data is divided into a 16-bit portion and 11-bit portion. The former portion is transferred to the printhead IJH as the print signal (DATA1) while the latter portion is transferred to the printhead IJH as the print signal (DATA2).

According to the embodiment described above, a print signal can be divided into two signals (DATA1 and DATA2) and transferred to the printhead serially by using one clock signal (CK). Even if the print signal per print cycle is long, it can be divisionally transferred with a simple control operation, thereby shortening the transfer time of the print signal. When the driving periods of the heat generating elements H1 to H324 and the transfer time of the print signal overlap in the above manner, the time required for the print operation can be shortened. In this manner, the speed of the print operation can be increased.

If control operation is performed so that the print signals are transferred only after the heat generating elements H1 to H324 are driven, the 16-bit latch circuit 104, 11-bit latch circuit 106, and 4-bit latch circuit 109 shown in FIG. 4 can be omitted from the driving circuit of the printhead. This can reduce the circuit size.

According to this embodiment, as is apparent from the timing chart of FIG. 5, the print signals (DATA1 and DATA2) are fetched by the 16-bit shift register 103, 5-bit shift register 108, and 11-bit shift register 105 by using the leading and trailing edges of the clock signal (CK). However, the present invention is not limited by this. For example, the print signals may be fetched in synchronism with only the leading or trailing edge of the clock signal (CK).

Furthermore, the arrangement of each shift register may be changed from one formed of flip-flop circuits which operate in synchronism with the edge of the clock signal (CK) to one formed of latch circuits made of through latches. Similarly, the arrangement of each of the 16-bit latch circuit 104, 11-bit latch circuit 106, and 4-bit latch circuit 109 may be changed from one formed of latch circuits to one formed of flip-flop circuits. The latch logic of the latch circuits may be changed to high through. If the latch circuit is to be formed of flip-flop circuits, it may fetch a signal either at the leading or trailing edge of the latch signal.

In place of the AND gate 107 with the above arrangement, an AND gate for obtaining the logical products of the block select signal (N1 to N12) as the output from the 4→12 decoder 110 and the enable signal (ENB) may be provided. Calculation of the logical products of the block select signal (N1 to N12) as the output from the 4→12 decoder 110, the enable signal (ENB), and the outputs from the 16- and 11-bit latch circuits 104 and 106 may be realized by using three-input AND circuits A1 to A324.

In the embodiment described above, the block control signal (B1 to B4) is transferred serially by using the same signal line as that used for transferring the print data (DATA2). After that, the transferred block control signal is decoded. Alternatively, the block select signal (N1 to N12) itself may be transferred serially, so the 4→12 decoder 110 may be omitted.

In the embodiment described above, the print data (DATA2) and the block control signal (B1 to B4) succeeding this print data are transferred to the shift register 108. The print data (DATA2) is then transferred to the shift register 105 via the shift register 108. Alternatively, the print data (DATA2) may be input to the shift register 105, and the block control signal (B1 to B4) may be transferred prior to transfer of the print data (DATA2).

The print signals (DATA1 and DATA2) and the block control signal may be assigned to the signal lines in any manner.

In the embodiment described above, the print signals are transferred by the two signal lines (signal lines for respectively transferring the print signals DATA1 and DATA2). However, the present invention is not limited to this. In a printhead with a large number of heat-generating elements, the number of print lines may be further increased from 2, as a matter of course.

As shown in FIG. 6, the shift register and latch circuit connected to DATA1 and the shift register and latch circuit connected to DATA2 are laid out on the two sides of the printing element arrays, as compared with the case wherein the shift registers and latch circuits connected to DATA1 and DATA2 are connected to the terminals of opposing sides from the viewpoint of chip layout and laid out on one side of the printing element arrays. The shift registers and latch circuits can be uniformly laid out to improve the circuit balance. The total layout area can be reduced, and the yield from one semiconductor wafer increases. Therefore, the cost of the printhead can be reduced.

In the above embodiments, droplets discharged from the printhead are ink droplets, and a liquid stored in the ink tank is ink. However the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heat generating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, as described in Japanese Patent laid Open No. 54-56847 or Japanese Patent Laid Open No. 60-71260, an ink may be supplied in a form of perforated sheet opposed to the electrothermal transducer in which the ink is maintained in liquid or solid within a dent or a through-hole thereon. In the present invention, the above-mentioned film boiling system is most effective for the above-mentioned inks.

In addition, a printing apparatus according to the present invention can have other embodiments, for example, one in which a printing apparatus is provided as an image output terminal integrally to or separate from an information processing device such as a computer, or the printing apparatus may be a copying apparatus combined with a reader or the like, or a facsimile apparatus with a transmitting/receiving function.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program code for performing the aforesaid processes to a computer system or apparatus (e.g., a personal computer), reading the program code, by a CPU or MPU of the computer system or apparatus, from the storage medium, then executing the program. In this case, the program code read from the storage medium realize the functions according to the embodiments, and the storage medium storing the program code constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program code.

Furthermore, additional functions according to the above embodiments are realized by executing the program code which are read by a computer. The present invention includes a case where an OS (operating system) or the like working on the computer performs a part or entire process in accordance with designations of the program code and realizes functions according to the above embodiments.

Furthermore, the present invention also includes a case where, after the program code read from the storage medium are written in a function expansion card which is inserted into the computer or in a memory provided in a function expansion unit which is connected to the computer, a CPU or the like contained in the function expansion card or function expansion unit performs a part or entire process in accordance with designations of the program code and realizes functions of the above embodiments.

As has been described above, according to the present invention, print signals necessary for driving the M printing elements belonging to each of the N divisional blocks and the select control signal necessary for block selection are transferred by inputting the print signals corresponding to the L (L<M) printing elements serially from the first signal line by using the clock signal and inputting the print signals corresponding to the remaining (M−L) printing elements and the corresponding select control signal serially from the second signal line by using the same clock signal. Even when a printhead with a large number of printing elements is to be used, a signal formed of the print signals and select control signal can be transferred from a printing apparatus by dividing it into a plurality of pieces of serial data. Therefore, the transfer time of the serial data can be shortened.

As a result, the print time is shortened, so the total print speed can be improved.

Since the print signals are transferred by using the same clock signal, complicated transfer control is not needed, and the data transfer time can be shortened with a simple arrangement.

As many apparently widely different embodiments of the present invention can be made without departing from the spirit and scope thereof, it is to be understood that the invention is not limited to the specific embodiments thereof except as defined in the appended claims.

What is claimed is:

1. A printhead comprising:

M×N printing elements;

M×N driving circuits for dividing said M×N printing elements into N blocks each consisting of M printing elements and time-divisionally driving each block of M printing elements;

a first shift register for inputting print signals corresponding to a number L of said M printing elements, wherein L<M and said signals are input serially from a first signal line by using a clock signal, and for temporarily storing the input print signals;

a second shift register for inputting print signals corresponding to (M−L) of said M printing elements, and a select control signal for selecting one of the N blocks, wherein said (M−L) print signals and said select control signal are input into said second shift register serially from a second signal line by using the clock signal, and for temporarily storing the input print signals and the select control signal;

a selective driving circuit for driving said M printing elements belonging to a block selected on the basis of the select control signal, by the print signals which are stored in said first and second shift registers and correspond to said M printing elements;

a first latch circuit for latching the print signals stored in said first shift register and corresponding to said L printing elements;

a second latch circuit for latching the print signals stored in said second shift register and corresponding to said (M−L) printing elements; and a third latch circuit for latching the select control signal stored in said second shift register, wherein L, M, and N are positive integers.

2. The printhead according to claim 1, further comprising a decoding circuit for decoding the select control signal latched by said third latch circuit, thus forming a block control signal for performing block selection.

3. The printhead according to claim 2, wherein said selective driving circuit includes an AND circuit for calculating logical products of the print signals latched by said first and second latch circuits and the block select signals and selects printing elements to drive on the basis of a calculation result of said AND circuit.

4. The printhead according to claim 2, wherein the block select control signal latched by said third latch circuit is a block select signal which does not need decoding.

5. The printhead according to claim 1, wherein said first, second, and third latch circuits perform latch operation in response to a common latch signal.

6. The printhead according to claim 1, wherein said M×N printing elements include electrothermal transducers.

7. The printhead according to claim 6, wherein said printhead includes an ink-jet printhead for printing by discharging ink.

8. The printhead according to claim 7, wherein said ink-jet printhead generates heat energy to be supplied to the ink by supplying power to said electrothermal transducers, so the ink is discharged by utilizing the heat energy.

9. A printhead cartridge comprising:

a printhead; and an ink tank for holding ink to be supplied to the printhead being connected to each other, the printhead comprising:

M×N printing elements;

M×N driving circuits for dividing said M×N driving elements into N blocks each consisting of M printing elements and time-divisionally driving each block of M printing elements;

a first shift register for inputting print signals corresponding to a number L of said M printing elements, wherein L<M and said signals are input serially from a first signal line by using a clock signal, and for temporarily storing the input print signals;

a second shift register for inputting print signals corresponding to (M−L) of said M printing elements, and a select control signal for selecting one of the N blocks, wherein said (M−L) print signals and said select control signal are input into said second shift register serially from a second signal line by using the clock signal, and for temporarily storing the input print signals and the select control signal;

a selective driving circuit for driving said M printing elements belonging to a block selected on the basis of the select control signal, by the print signals which are stored in said first and second shift registers and correspond to said M printing elements;

a first latch circuit for latching the print signals stored in said first shift register and corresponding to said L printing elements;

a second latch circuit for latching the print signals stored in said second shift register and correspond to said (M−L) printing elements; and a third latch circuit for latching the select control signal stored in said second shift register, wherein L, M, and N are positive integers.

10. The printhead cartridge according to claim 9, wherein the printhead and the ink tank can be separated from each other.

11. The printhead cartridge according to claim 9, wherein the printhead and the ink tank are integral with each other.

12. A printing apparatus for printing comprising:

a printhead; and control means for controlling so as to convert print data into print signals corresponding to M printing elements per block printing, and to transfer the print signals to the printhead through first and second signal lines by using a clock signal, the printhead comprising:

M×N printing elements;

M×N driving circuits for dividing said M×N driving elements into N blocks each consisting of M printing elements and time-divisionally driving each block of M printing elements;

a first shift register for inputting print signals corresponding to a number L of said M printing elements, wherein L<M and said signals are input serially from the first signal line by using the clock signal, and for temporarily storing the input print signals;

a second shift register for inputting print signals corresponding to (M−L) of said M printing elements, and a select control signal for selecting one of the N blocks, wherein said (M−L) print signals and said select control signal are input into said second shift register serially from the second signal line by using the clock signal, and for temporarily storing the input print signals and the select control signal;

a selective driving circuit for driving said M printing elements belonging to a block selected on the basis of the select control signal, byte print signals which are stored in said first and second shift registers and correspond to said M printing elements;

a first latch circuit for latching the print signals stored in said first shift register and corresponding to said L printing elements;

a second latch circuit for latching the print signals stored in said second shift register and corresponding to said (M−L) printing elements; and a third latch circuit for latching the select control signal stored in said second shift register, wherein L, M, and N are positive integers.

13. The printing apparatus according to claim 12, wherein said control means controls to transfer an enable signal, in order that while transferring the print signals corresponding to one block printing to the printhead, printing elements corresponding to one block for which transfer has been performed immediately before this transfer are driven, thereby printing.

14. A printing clement substrate comprising:

at least M printing elements×N blocks;

M×N driving circuits corresponding to said M printing elements×N blocks;

a first shift register for inputting print signals corresponding to a number L of said M printing elements, wherein L<M and said signals are input serially from a first signal line by using a clock signal, and for temporarily storing the input print signals;

a second shift register for inputting print signals corresponding to (M−L) of said M printing elements, and a select control signal for selecting one of the N blocks, wherein said (M−L) print signals and said select control signal are input into said second shift register serially from a second signal line by using the clock signal, and for temporarily storing the input print signals and the select control signal;

a selective driving circuit for driving said M printing elements belonging to a block selected on the basis of the select control signal, by the print signals which are stored in said first and second shift registers and correspond to said M printing elements;

a first latch circuit for latching the print signals stored in said first shift register and corresponding to said L printing elements;

a second latch circuit for latching the print signals stored in said second shift register and corresponding to said (M−L) printing elements; and a third latch circuit for latching the select control signal stored in said second shift register, wherein at least the M printing elements×N blocks, the M×N driving circuits, the first shift register, the second shift register, and the selective driving circuit are formed on one substrate, and wherein L, M, and N are positive intergers.

15. A printhead comprising:

a plurality of printing elements;

dividing/driving circuits for dividing said plurality of printing elements into a plurality of blocks and driving said plurality of blocks;

a first shift register for inputting print signals corresponding to, of print signals corresponding to a plurality of printing elements constituting one block, a predetermined number of printing elements serially from a first signal line by using a clock signal, and for temporarily storing the input print signals;

a second shift register for inputting print signals corresponding to printing elements different from said predetermined number of printing elements constituting said one block and a block select signal for selecting a block to be driven, wherein said print signals corresponding to printing elements different from said predetermined number of printing elements, and said block select signal are input into said second shift resister serially from a second signal line by using the clock signal, and for temporarily storing the input print signals and the block select signal;

a driving circuit for driving printing elements on the basis of the print signals stored in said first and second shift registers and the block select signal stored in said second shift register, a first latch circuit for latching the print signals stored in said first shift register and corresponding to said predetermined number of printing elements;

a second latch circuit for latching the print signals stored in said second shift register and corresponding to said printing elements different from said predetermined number of printing elements; and a third latch circuit for latching the select control signal stored in said second shift register.

16. A printing element substrate comprising:

a plurality of printing elements;

dividing/driving circuits for dividing said plurality of printing elements into a plurality of blocks and driving said plurality of blocks;

a first shift register for inputting print signals corresponding to, of print signals corresponding to a plurality of printing elements constituting one block, a predetermined number of printing elements serially from a first signal line by using a clock signal, and for temporarily storing the input print signals;

a second shift register for inputting print signals corresponding to printing elements different from said predetermined number of printing elements constituting said one block and a block select signal for selecting a block to be driven, wherein said print signals corresponding to printing elements different from said predetermined number of printing elements, and said block select signal are input into said second shift register serially from a second signal line by using the clock signal, and for temporarily storing the input print signals and the block selcct signal;

a driving circuit for driving printing elements on the basis of the print signals stored in said first and second shift register and the block select signal stored in said second shift register;

a first latch circuit for latching the print signals stored in said first shift register and corresponding to said predetermined number of printing elements;

a second latch circuit for latching the print signals stored in said second shift register and corresponding to said printing elements different from said predetermined number of printing elements; and a third latch circuit for latching the select control signal stored in said second shift register, wherein the plurality of printing elements, the dividing/driving circuits, the first shift register, the second shift registers, and the driving circuit are formed on one substrate.

* * * * *

UNITED STATES PATENT AND TRADEMARK OFFICE

CERTIFICATE OF CORRECTION

PATENT NO. : 6,629,742 B2
DATED : October 7, 2003
INVENTOR(S) : Yasuo Fujii

It is certified that error appears in the above-identified patent and that said Letters Patent is hereby corrected as shown below:

Column 1,
Line 52, “signal” should read -- signal. --.

Column 3,
Line 26, “comprises” should read -- comprising --;
Line 30, (Close up right margin); and
Line 31, (Close up left margin).

Column 4,
Line 16, “comprises” should read -- comprising --; and
Line 49, “comprises” should read -- comprising --.

Column 5,
Line 2, “comprises” should read -- comprising --; and
Line 48, “when” should read -- when a --.

Column 7,
Line 2, “for” should read -- for a --.

Column 9,
Line 12, “when” should read -- when a --.

Column 13,
Line 1, “of” should read -- of a --;
Line 26, “realize” should read -- realizes --; and
Line 42, “are” should read -- is --.

Column 15,
Line 36, “correspond” should read -- corresponding --.

Column 16,
Line 9, “byte” should read -- by the --.

Column 17,
Line 24, “register,” should read -- register; --.

UNITED STATES PATENT AND TRADEMARK OFFICE

CERTIFICATE OF CORRECTION

PATENT NO. : 6,629,742 B2
DATED : October 7, 2003
INVENTOR(S) : Yasuo Fujii

It is certified that error appears in the above-identified patent and that said Letters Patent is hereby corrected as shown below:

Column 18,
Line 19, “selcct” should read -- select --;
Line 22, “register” should read -- registers --; and
Line 36, “registers,” should read -- register, --.

Signed and Sealed this

Thirteenth Day of January, 2004

JON W. DUDAS
*Acting Director of the United States Patent and Trademark Office*